US008419180B2

(12) United States Patent
Ishii et al.

(10) Patent No.: US 8,419,180 B2
(45) Date of Patent: Apr. 16, 2013

(54) FIXED MATERIAL TRANSPORTATION APPARATUS AND LIQUID FIXING APPARATUS

(75) Inventors: Takayuki Ishii, Nagano (JP); Yoshitaka Shimada, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 679 days.

(21) Appl. No.: 11/484,619

(22) Filed: Jul. 12, 2006

(65) Prior Publication Data

US 2006/0250473 A1 Nov. 9, 2006

Related U.S. Application Data

(62) Division of application No. 10/272,286, filed on Oct. 17, 2002, now Pat. No. 7,101,032.

(30) Foreign Application Priority Data

Oct. 17, 2001 (JP) ..... P2001-319516
Mar. 29, 2002 (JP) ..... P2002-093828

(51) Int. Cl.
*B41J 2/01* (2006.01)

(52) U.S. Cl.
USPC ..... 347/104

(58) Field of Classification Search ..... 347/104, 347/102; 271/196, 197, 276; 355/73; 400/635
See application file for complete search history.

(56) References Cited

U.S. PATENT DOCUMENTS 3,182,998 A 5/1965 Peterson
4,437,659 A 3/1984 Caron et al.
4,721,968 A * 1/1988 Arai et al. ..... 347/104
5,139,253 A 8/1992 Bohme et al.
5,197,812 A 3/1993 Worley et al.
5,291,227 A 3/1994 Suzuki
5,601,629 A 2/1997 Helbing
5,832,826 A 11/1998 Mack et al.
5,874,979 A 2/1999 Ohyama
5,967,510 A 10/1999 Ono et al.
6,038,776 A 3/2000 Yamada et al.
6,043,836 A 3/2000 Kerr et al.

(Continued)

FOREIGN PATENT DOCUMENTS

CA 2291925 A1 6/2000
EP 0992347 A2 4/2000

(Continued)

OTHER PUBLICATIONS

Final Office Action, dated Sep. 26, 2011, issued by the US Patent Office in related U.S. Appl. No. 12/700,333.

(Continued)

*Primary Examiner* — Julian Huffman
(74) *Attorney, Agent, or Firm* — Sughrue Mion, PLLC

(57) ABSTRACT

A fixed material transportation surface of the fixed material transportation apparatus is formed inclining so as to become higher toward a downstream side from an upstream side of transportation direction of the fixed material, and is transported while sucking the fixed material supplied on the fixed material transportation surface. Thus, since the cockling is drawn when the fixed material is transported while being raised to transportation direction on the fixed material transportation surface even if cockling extending to transportation direction generates on the fixed material after fixing, growth of the cockling can be prevented.

4 Claims, 7 Drawing Sheets

U.S. PATENT DOCUMENTS

| | | | | |
|---|---|---|---|---|
| 6,048,120 | A | 4/2000 | Kerr | |
| 6,092,894 | A | 7/2000 | Nuita et al. | |
| 6,172,741 | B1 | 1/2001 | Wotton et al. | |
| 6,176,482 | B1 | 1/2001 | Reinhard et al. | |
| 6,196,672 | B1 | 3/2001 | Ito et al. | |
| 6,224,203 | B1 | 5/2001 | Wotton et al. | |
| 6,254,090 | B1 | 7/2001 | Rhodes et al. | |
| 6,254,092 | B1 | 7/2001 | Yraceburu et al. | |
| 6,270,215 | B1 | 8/2001 | Miyasaka et al. | |
| 6,296,403 | B1 | 10/2001 | Duchovne | |
| 6,315,404 | B1 | 11/2001 | Wotton et al. | |
| 6,357,869 | B1 | 3/2002 | Rasmussen et al. | |
| 6,406,017 | B1 | 6/2002 | Yaneda | |
| 6,409,332 | B1 | 6/2002 | Yraceburu et al. | |
| 6,454,478 | B2 | 9/2002 | Wotton et al. | |
| 6,497,522 | B2 | 12/2002 | Wotton et al. | |
| 6,511,172 | B2 | 1/2003 | Tanno et al. | |
| 6,517,179 | B2 | 2/2003 | Hinojosa et al. | |
| 6,575,554 | B2 | 6/2003 | Yoshinaga | |
| 6,729,720 | B2 | 5/2004 | Miki et al. | |
| 6,752,495 | B2 * | 6/2004 | Izuma | 347/108 |
| 6,927,841 | B2 | 8/2005 | Hinojosa et al. | |
| 6,964,466 | B1 | 11/2005 | Kodama et al. | |
| 7,114,445 | B2 | 10/2006 | Ackley, Jr. et al. | |
| 2002/0015610 | A1 | 2/2002 | Beehler et al. | |
| 2002/0047885 | A1 | 4/2002 | Miyawaki et al. | |
| 2002/0126191 | A1 | 9/2002 | Fujioka | |
| 2003/0085980 | A1 | 5/2003 | Ishii et al. | |
| 2004/0169712 | A1 | 9/2004 | Tsuji | |

FOREIGN PATENT DOCUMENTS

| | | | |
|---|---|---|---|
| EP | 1008454 | A1 | 6/2000 |
| EP | 1223042 | A1 | 7/2002 |
| GB | 2 357 995 | | 7/2001 |
| GB | 2 357 995 | A | 7/2001 |
| JP | 63-303781 | | 12/1988 |
| JP | 3-000270 | | 1/1991 |
| JP | 05-053462 | A | 3/1993 |
| JP | 5-105260 | A | 4/1993 |
| JP | 6-143705 | A | 5/1994 |
| JP | 07-009712 | A | 1/1995 |
| JP | 07-017087 | A | 1/1995 |
| JP | 08-156351 | A | 6/1996 |
| JP | 09-058897 | A | 3/1997 |
| JP | 9-220837 | A | 8/1997 |
| JP | 09-269619 | A | 10/1997 |
| JP | 10-268676 | A | 10/1998 |
| JP | 11-301880 | A | 11/1999 |
| JP | 2000-016637 | A | 1/2000 |
| JP | 2000-158678 | A | 6/2000 |
| JP | 2000-191175 | A | 7/2000 |
| JP | 2000-238353 | A | 9/2000 |
| JP | 2000-006387 | A | 11/2000 |
| JP | 2000-327172 | A | 11/2000 |
| JP | 2000-351203 | A | 12/2000 |
| JP | 2001-162870 | A | 6/2001 |
| JP | 2001-213013 | A | 8/2001 |
| JP | 2001-347691 | A | 12/2001 |
| JP | 2001-347710 | A | 12/2001 |
| JP | 2002-127516 | A | 5/2002 |
| JP | 2002-225358 | A | 8/2002 |
| WO | 00/34158 | A1 | 6/2000 |
| WO | WO 00/34158 | A1 | 6/2000 |
| WO | WO-01/83344 | * | 11/2007 |

OTHER PUBLICATIONS

Non-Final Office Action, dated Jun. 6, 2011, issued by the US Patent Office in related U.S. Appl. No. 12/700,333.

* cited by examiner

FIXED MATERIAL TRANSPORTATION APPARATUS AND LIQUID FIXING APPARATUS

This application is a divisional of application Ser. No. 10/272,286 filed on Oct. 17, 2002, now U.S. Pat. No. 7,101,032 which is a utility application. Also the present application claims priority upon Japanese Patent Application No. P2001-319516 filed Oct. 17, 2001, and Japanese Patent Application No. P2002-093828 filed Mar. 29, 2002, the contents of which are herein incorporated by reference.

BACKGROUND OF THE INVENTION

The present invention relates to a fixed material transportation apparatus transporting a fixed material and a liquid fixing apparatus.

Up to now, there is a construction transporting a sheet, for example, being one of the fixed material, to a recording portion by a sheet transportation apparatus and transporting outside while recording in an ink jet printer, for example, being one of apparatuses for fixing liquid. FIG. 9A is a view showing only the main portion of the sheet transportation apparatus in such the ink jet printer. In such the ink jet printer, recording is performed by a recording head 3 while transporting a sheet 1 sandwiching with a delivery roller 2 and a driven roller thereof 2*a*, and the sheet 1 is transported to discharge by sandwiching with a discharging roller 4 and a rowel spur 4*a* as a driven roller.

In the ink jet printer providing the above prior sheet transportation apparatus, the sheet 1 sucks large quantity of ink and rises in wave shape to the recording head 3 side, that is, so-called cockling possibly generates as shown in FIG. 9B at the case that picture to which many ink drops are discharged such as solid picture for example is recorded on the sheet 1. When the cockling generates and grows, a gap between the sheet 1 and the recording head 3 becomes uneven, recording unevenness generate by dispersion of flying distance of the ink drops, or there is a fault that the sheet gets dirty by contacting the recording head 3.

These drawbacks can be prevented by depressing the above cockling in allowance if the span between the delivery roller 2 and the discharging roller 4 is comparatively short. However, it is necessary in near future to increase number of nozzles of every nozzle of each color or to arrange nozzle lines of plural colors to transportation direction of the sheet 1 to make recording speed further high in the ink jet printer and the like. In these cases, dimension of the recording head 3 becomes long to transportation direction of the sheet 1 as shown in FIG. 9C.

When the recording head 3 is long, span between the delivery roller 2 and the discharging roller 4 becomes long so as not to prevent absolutely the cockling in the construction transporting and discharging by sandwiching with the delivery roller 2 and the driven roller 2*a*, and the discharging roller 4 and rowel spur 4*a* as the driven roller thereof. Then cockling goes over allowance, and it is considerable that the construction transporting and discharging by sandwiching with such the two pairs of rollers itself is not realized depending on the ink jet printer having long head length.

Such the cockling is comparatively small at using exclusive sheet for ink jet printer as the sheet 1, and is large at using normal sheet. Because of that, paper gap (gap A between the sheet 1 and the recording head 3 in FIG. 9A) is set large considering rise of the sheet caused by cockling at using the normal sheet in the design of ink jet printer and the like. However, when the paper gap is large like this, ink particles discharged from the nozzle of the recording head generate flying curve and dispersion of point of impact becomes large for the flying curve so as to prevent possibly improvement of recording quality.

On the other hand, various kinds of printers having mainly a sucking portion of hollow box shape at transportation surface of the sheet and sucking the sheet through plural penetrating sucking holes provided at the sucking portion by a sucking pump and the like are proposed in recent yeas (see Japanese Unexamined Patent Publications JP-A-63-303781, JP-A-3-270, etc.). Among them, there is a printer proposed that the sheet is sucked to a platen and the like through these sucking holes.

However, only through holes are opened to suck at the sucking portion of the hollow box shape in both of them, and it is difficult to prevent the above cockling over whole surface of the sheet in the recording portion. Further, since the related art described in the above official gazette has the construction that only through holes are opened to suck at the sucking portion of the hollow box shape, strong sucking force possibly causes fall of transportation accuracy. Because of that, in the present circumstances, a printer is not made practicable except a part of large-sized printer performing transportation (using its own weight of the sheet for transportation) to gravity direction as the actual situation.

SUMMARY OF THE INVENTION

The invention is performed in view of the above various problems, and an object is to provide a fixed material transportation apparatus and a liquid fixing apparatus having the fixed material transportation apparatus enabling to prevent growth of cockling more usefully at transporting the fixed material.

(1) In order to achieve the above object, There is provided a fixed material transportation apparatus comprising:

a fixed material transportation surface on which a fixed material is transported while being sucked;

wherein the fixed material transportation surface is formed so as to become higher toward a downstream side from an upstream side of a transportation direction of the fixed material.

According to the above construction, since the cockling is drawn when the fixed material is transported while being raised to transportation direction on the fixed material transportation surface even if cockling extending to transportation direction generates on the fixed material after fixing, growth of the cockling can be prevented.

(2) In the invention, it is characterized in that the fixed material transportation surface is inclined in curved concave shape in the above fixed material transportation apparatus. Thus, since the top end of the fixed material advances along the fixed material transportation surface curved in concave shape, the fixed material can be transported smoothly without sticking of the fixed material.

(3) In order to achieve the above object, there is provided a fixed material transportation apparatus comprising:

a fixed material transportation surface on which a fixed material is transported while being sucked;

wherein the fixed material transportation surface is formed so as to become lower toward a downstream side from an upstream side of a transportation direction of the fixed material.

Thus, since the cockling is drawn when the fixed material is transported while falling to transportation direction on the fixed material transportation surface by its own weight even if cockling extending to transportation direction generates on the fixed material after fixing, growth of the cockling can be prevented.

(4) In the invention, it is characterized in that the fixed material transportation surface formed as an inclined surface is formed in curved convex shape in the fixed material transportation apparatus. Thus, since the top end of the fixed material is transported along the fixed material transportation surface curved in convex shape, it is possible to transport smoothly without sticking the fixed material.

(5) In the invention, it is characterized that the fixed material transportation surface includes a planar surface. Thus, since the fixed material is bent with the predetermined angle at interring in the inclined surface, force at drawing the cockling is applied with strong force with concentration.

(6) In the invention, it is characterized that a fixing area fixing liquid to the fixed material in the fixed material transportation surface is formed flat in the fixed material transportation apparatus. Thus, since gap between the fixed material and fixing head can be uniform, fixing accuracy can be kept in highly accurate state.

(7) In order to achieve the above object, there is provided fixed material transportation apparatus comprising:

a fixed material transportation surface on which a fixed material is transported while being sucked;

wherein a step portion is formed between a fixing area fixing liquid to the fixed material and an area of a downstream side of transportation direction from the fixing area in the fixed material transportation apparatus.

(8) In the invention, it is characterized in that the fixing area is formed so as to become higher than the area of the downstream side in the fixed material transportation apparatus. Thus, since the cockling is drawn when the fixed material is transported while falling to transportation direction on the fixed material transportation surface by its own weight even if cockling extending to the transportation direction generates on the fixed material after fixing, growth of the cockling can be prevented.

(9) In the invention, it is characterized that the fixing area and the area of the downstream side are formed planar in the fixed material transportation apparatus. Thus, since a gap between the fixed material and fixing head can be uniform, liquid fixing accuracy can be kept in highly accurate state. The fixed material is transported while keeping the almost planar state preventing growth of cockling.

(10) In the invention, a fixed material transportation apparatus is characterized by comprising plural sucking holes provided at the fixed material transportation surface, a decompression chamber connecting to the sucking holes, and a sucking device sucking air in the decompression chamber, wherein the sucking holes provides a suction unit in which each of sucking holes is provided with a sucking aperture connecting to the decompression chamber and a sucking chamber where an area of sucking surface facing the fixed material is larger than a sectional area of the sucking aperture.

(11) In order to achieve the above object, there is provided a liquid fixing apparatus in which the fixed material transportation apparatus as described above is mounted. Thus, the liquid fixing apparatus having the above-mentioned advantages is provided.

DESCRIPTION OF THE PREFERRED EMBODIMENTS

Embodiments of an inkjet printer transporting a recording medium which is one of an embodied liquid fixing apparatus of the invention will be described referring figures below.

Figure 1:
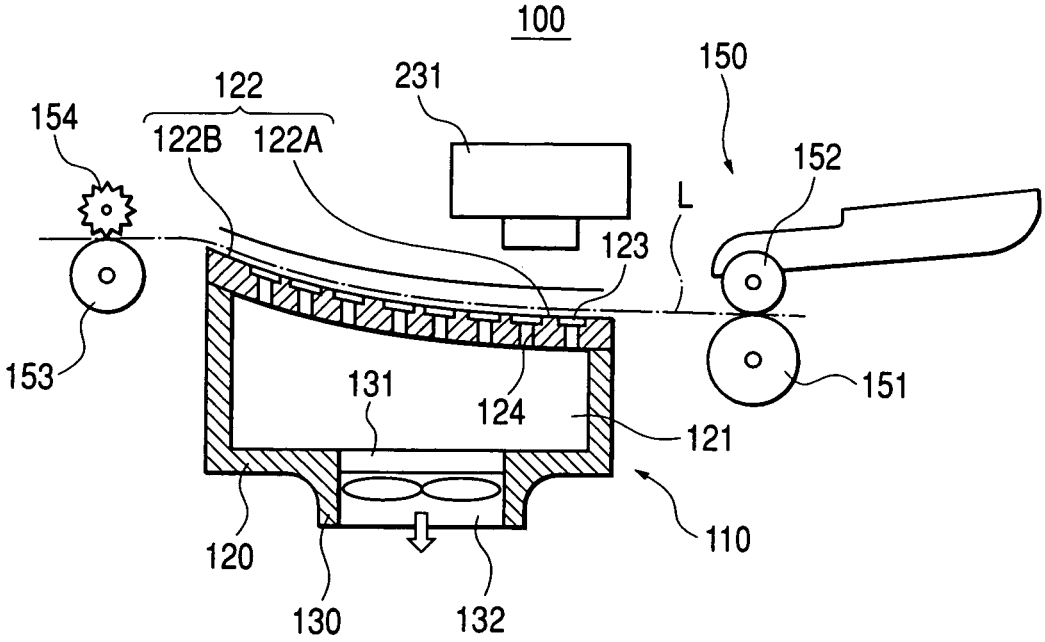
FIG. 1 is a side view showing a recording medium transportation apparatus according to a first embodiment of the invention.
Figure 2:
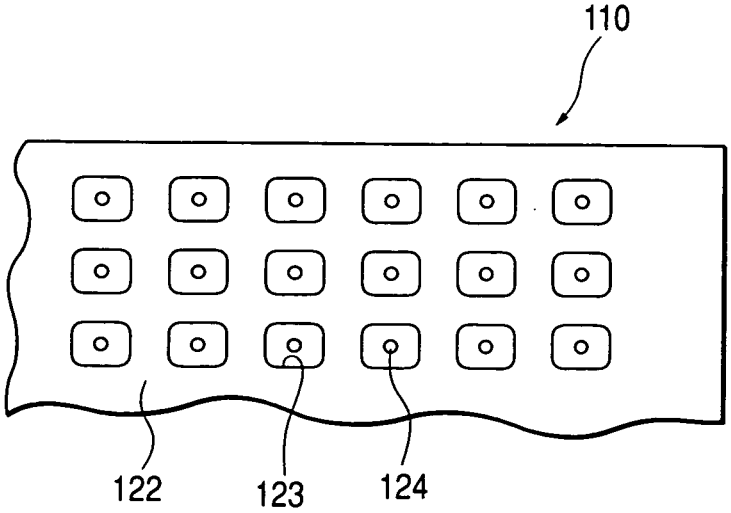
FIG. 2 is a plan view showing a recording medium transportation surface of the recording medium transportation apparatus of FIG. 1.

FIG. 1 is a sectional view showing a recording medium transportation apparatus according to a first embodiment of the invention. The recording medium transportation apparatus 100 provides a suction unit 110 sucking and keeping the recording medium at recording and a recording medium transportation device 150 transporting the recording medium to the downstream side from the upstream side of the suction unit 110. The above suction unit 110 is arranged at lower side putting a recording medium transportation passage L to the recording head 231 for printing at the recording medium. The suction unit 110 is formed in hollow box shape of construction of two stages, up and down, consisting of a sucking portion 120 of the upper stage and a sucking force generating portion 130 of the lower stage.

The sucking portion 120 has a decompression chamber 121 formed inside, plural sucking chamber 123 formed with almost rectangle concave at the recording medium transportation surface 122, and plural sucking apertures 124 extending to up and down directions and having smaller sectional area than the above sucking chamber 123.

Although the recording medium transportation surface 122 is formed flat at a recording area 122A facing a recording 231, the recording medium transportation surface 122 is inclined so as to become higher toward the downstream side from the upstream side, that is, is formed at a wrapped surface to upper side (reversely wrapped surface, hereafter) toward discharging direction of the recording medium. Incidentally, flat means here that a surface does not have inclination.

The sucking force generating portion 130 is connected to the decompression chamber 121 of the sucking portion 120 through a connecting aperture 131, and has a pump 132 providing a centrifugal fan at inside thereof. The pump 132 is attached at the lower predetermined position of the decompression chamber 121 through the connecting aperture 131 at the state connecting to the decompression chamber 121, and the centrifugal fan rotates at recording.

The recording medium transportation device 150 provides a delivery roller 151 transporting the recording medium between the recording head 231 and the suction unit 110, a driven roller 152 being pressed from upper side to the delivery roller 151, a discharging roller 153 discharging the recording medium outside, and a spur roller 154 being contacted from upper side to the discharging roller 153. It is possible not to provide the discharging roller 153 the spur roller 154 by constructing so as to enable to move the suction unit 110 to discharging direction.

As described above, utilization factor of negative pressure enabling to use for characteristic of the pump 132 is made high by constructing a sucking hole with a sucking aperture 124 and a sucking chamber 123, and further forming the sucking aperture 124 with a penetrating aperture of small diameter, and large sucking force can be generated to the recording medium by forming the sucking chamber 123 as a larger, almost rectangle concave in area than the sucking aperture 124.

Since the recording medium is curved in concave shape by being transported while being raised to transportation direction on an area 122B of the recording medium transportation surface 122 by forming the area 122B of the recording medium transportation surface 122, cockling generating after recording can be drawn so as to prevent growth of the cockling. Further, since the top end of the recording medium advances along the area 122B of the recording medium transportation surface 122 curved in concave shape, the recording medium can be transported smoothly without sticking of the recording medium.

Although the area 122B of the recording medium transportation surface 122 is formed as an inclined surface curved in concave shape in the embodiment shown in FIG. 1, it may be formed as planar surface having inclination. Here, planar means that a surface is not curved. In this case, since the recording medium is bent with the predetermined angle at interring in the inclined surface, force at drawing the cockling is applied with strong force with concentration. It is desirable to form an angle of elevation of the above inclined surface, for example, 2 degree to 15 degree, preferably, 5 degree to 11 degree.

The recording medium transportation apparatus 100 having such the construction operates as the following. The recording medium is transported between the recording head 231 and the suction unit 110 driving to rotate the delivery roller 151 and the like. On the other hand, sucking force operates to the sucking aperture 124 and the sucking chamber 123 through the connecting aperture 131 and the decompression chamber 121 being driven by the pump 132. Thus, the recording medium is transported at the state being sucked to suck to the recording medium transportation surface.

At the same time, the recording head 231 records discharging ink particle to the recording medium while moving the upper side of the recording medium to main scanning direction. Thus, although cockling possibly generated at recording medium after recording, the recording medium is curved in concave shape by being transported along the recording medium transportation surface 122 formed as a reversely curved surface so as to prevent the growth of the cockling by drawing the cockling. The recording medium having finished recording discharges outside driving to rotate the discharging roller 153 and the like.

Figure 3:
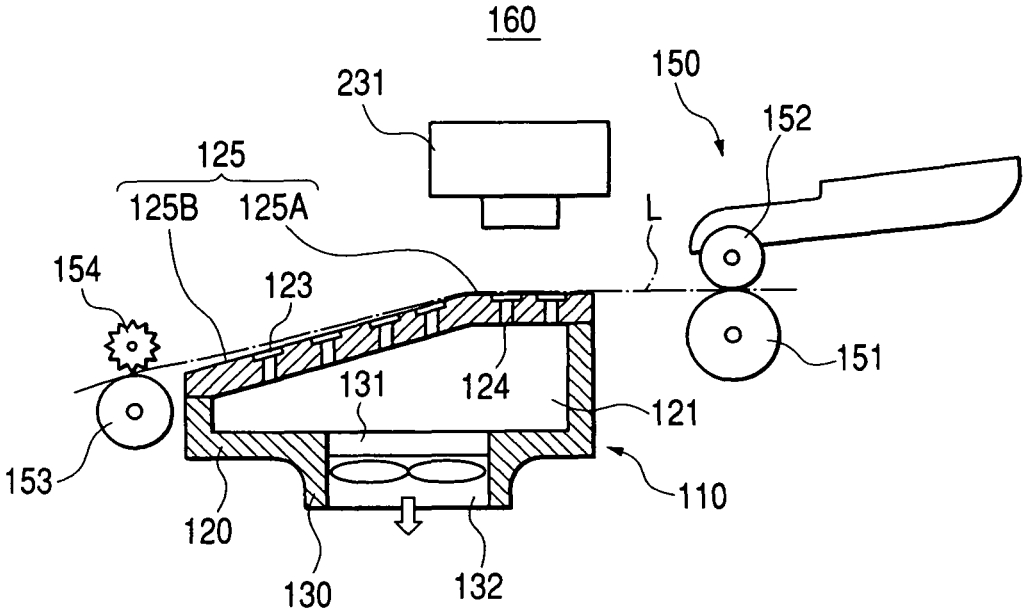
FIG. 3 is a side view showing a recording medium transportation apparatus according to a second embodiment of the invention.

FIG. 3 is a side view showing the recording medium transportation apparatus according to a second embodiment of the invention corresponding to FIG. 1, and for the same component elements as the recording medium transportation apparatus 100 shown in FIG. 1, the description will be omitted adding the same symbols. In the recording medium transportation apparatus 160, the recording medium transportation surface 125 at the sucking portion 120 is formed flat not having inclination substantially at recording area 125A facing the recording head 231. However at an area 125B of the downstream side from the recording area 125A, the point that the recording medium transportation apparatus 160 is formed inclining so as to become low to the downstream side from the upstream side, that is, at a curved surface (positively curved surface, hereafter) lower side facing discharging direction of the recording medium is different from the recording medium transportation apparatus 100.

Thus, since the recording medium is curved in convex shape being transported while falling on the area 125B of the recording medium transportation surface 125 with its own weight to transportation direction even by forming the area 125B of the recording medium transportation surface 125 as the positively curved surface, growth of the cockling is prevented by drawing the cockling generating after recording. Further, since the top end of the recording medium is transported along the area 125B of the recording medium transportation surface 125 curved in convex shape, it is possible to transport smoothly without sticking the recording medium.

Although the area 125B of the recording medium transportation surface 125 is formed as an inclined surface curved in convex shape in the embodiment shown in FIG. 3, it may be formed as flat surface. In this case, since the recording medium is bent with the predetermined angle at interring in the inclined surface, force at drawing the cockling is applied with strong force with concentration. It is desirable to form an angle of elevation of the above inclined surface, for example, 2 degrees to 15 degrees, preferably, 5 degrees to 11 degrees.

Figure 4:
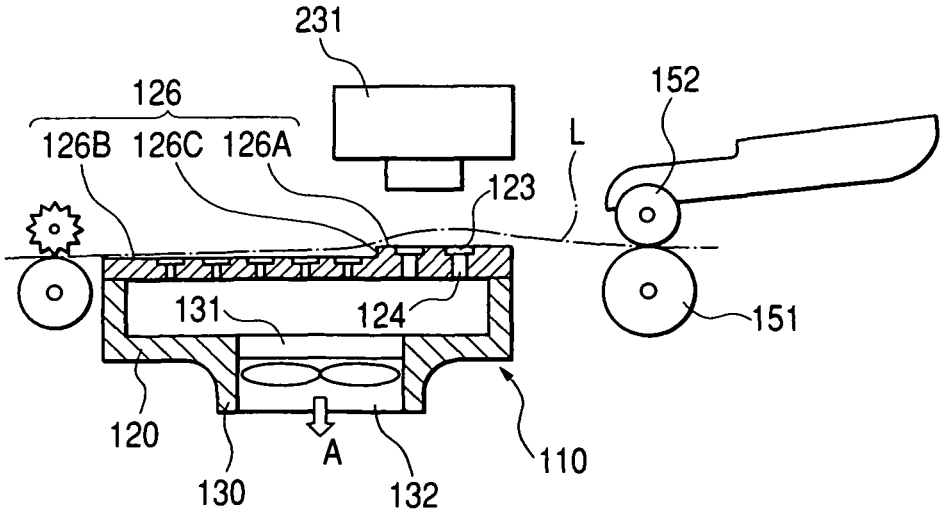
FIG. 4 is a side view showing a recording medium transportation apparatus according to a third embodiment of the invention.

FIG. 4 is a side view showing the recording medium transportation apparatus according to a third embodiment of the invention corresponding to FIG. 1, and for the same component elements as the recording medium transportation apparatus 100 shown in FIG. 1, the description will be omitted adding the same symbols. In the recording medium transportation apparatus 170, the recording medium transportation surface 126 at the sucking portion 120 is formed planar at recording area 126A facing the recording head 231. However at an area 126B of the downstream side from the recording area 126A, the point that a step portion 126C is formed between areas 126A and 126B so that the recording area 126A is higher than the area 126B of the downstream side is different from the recording medium transportation apparatus 100.

Thus, since the recording medium is bent in almost S shape being transported while falling on the area 126B of the recording medium transportation surface 126 with its own weight to transportation direction even by forming the step portion 126C between the areas 126A and 126B of the recording medium transportation surface 126, growth of the cockling is prevented by drawing the cockling generating after recording. The step portion 126C is desirable that length is roughly the same as the width of the recording medium to width direction thereof and height is 1 to 5 mm for example.

Figure 5:
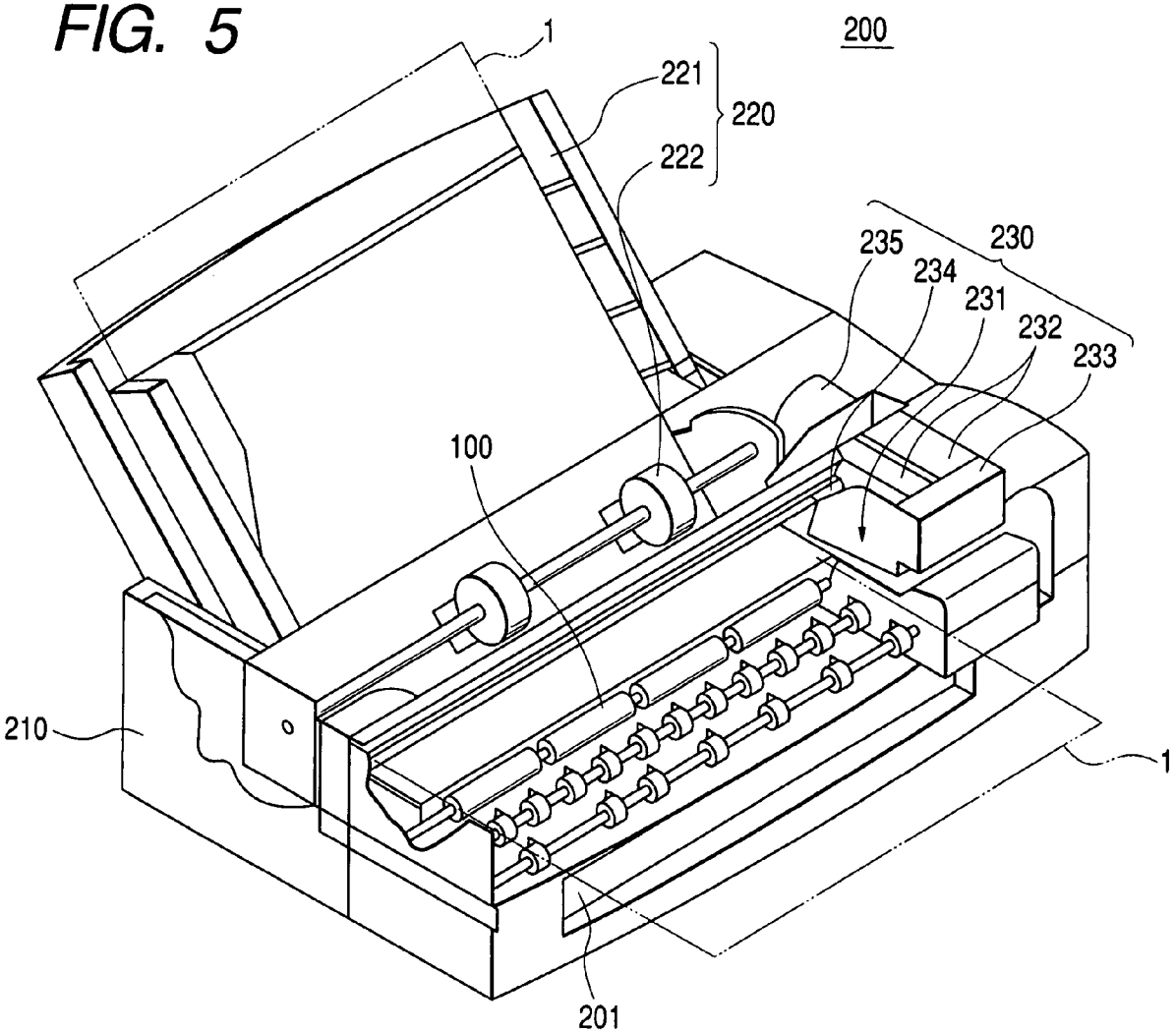
FIG. 5 is a perspective view showing an ink jet printer as a recording apparatus providing the recording medium transportation apparatus of the invention.
Figure 6:
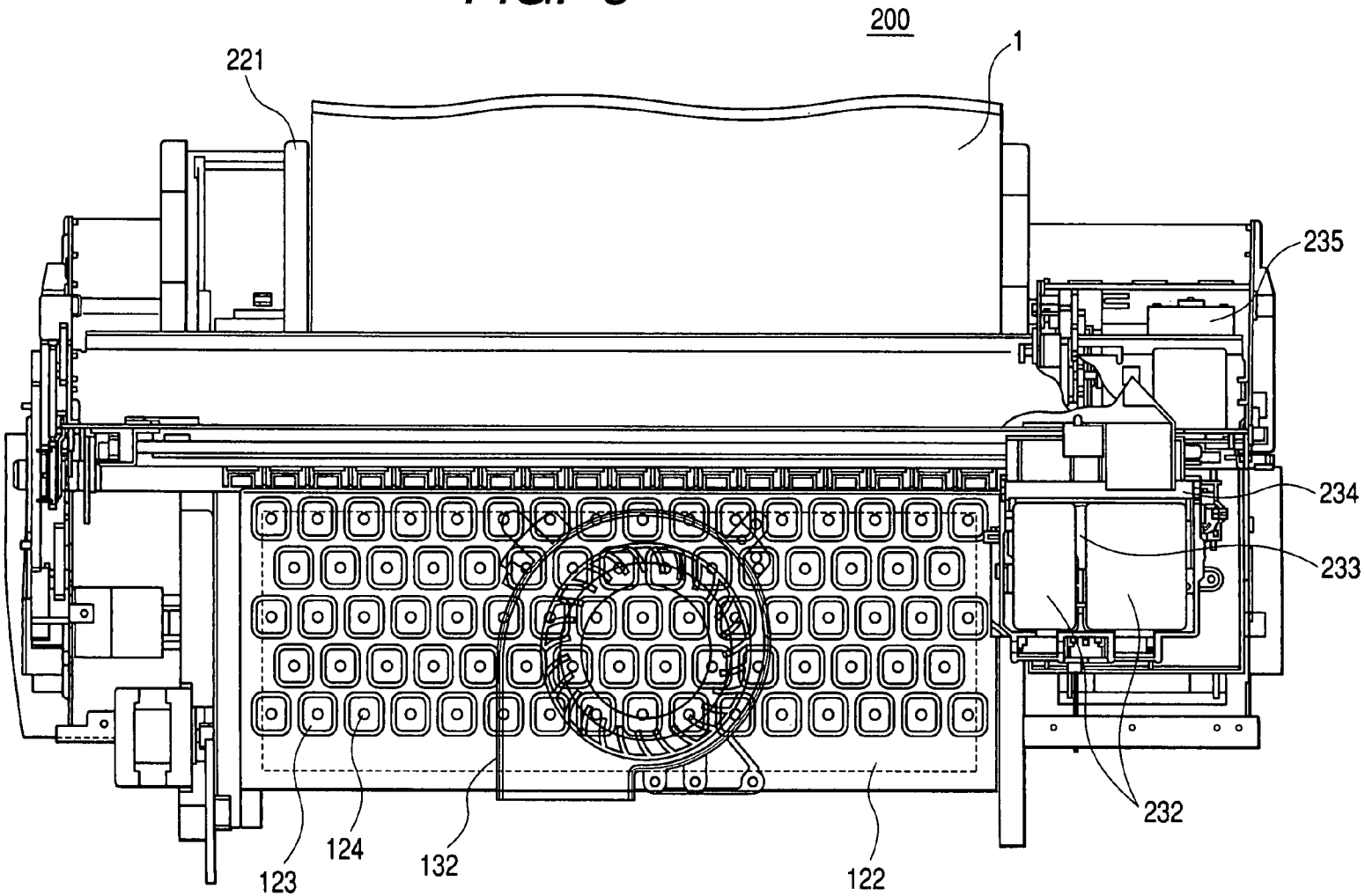
FIG. 6 is a plan view showing a main portion of the ink jet printer of FIG. 5.
Figure 7:
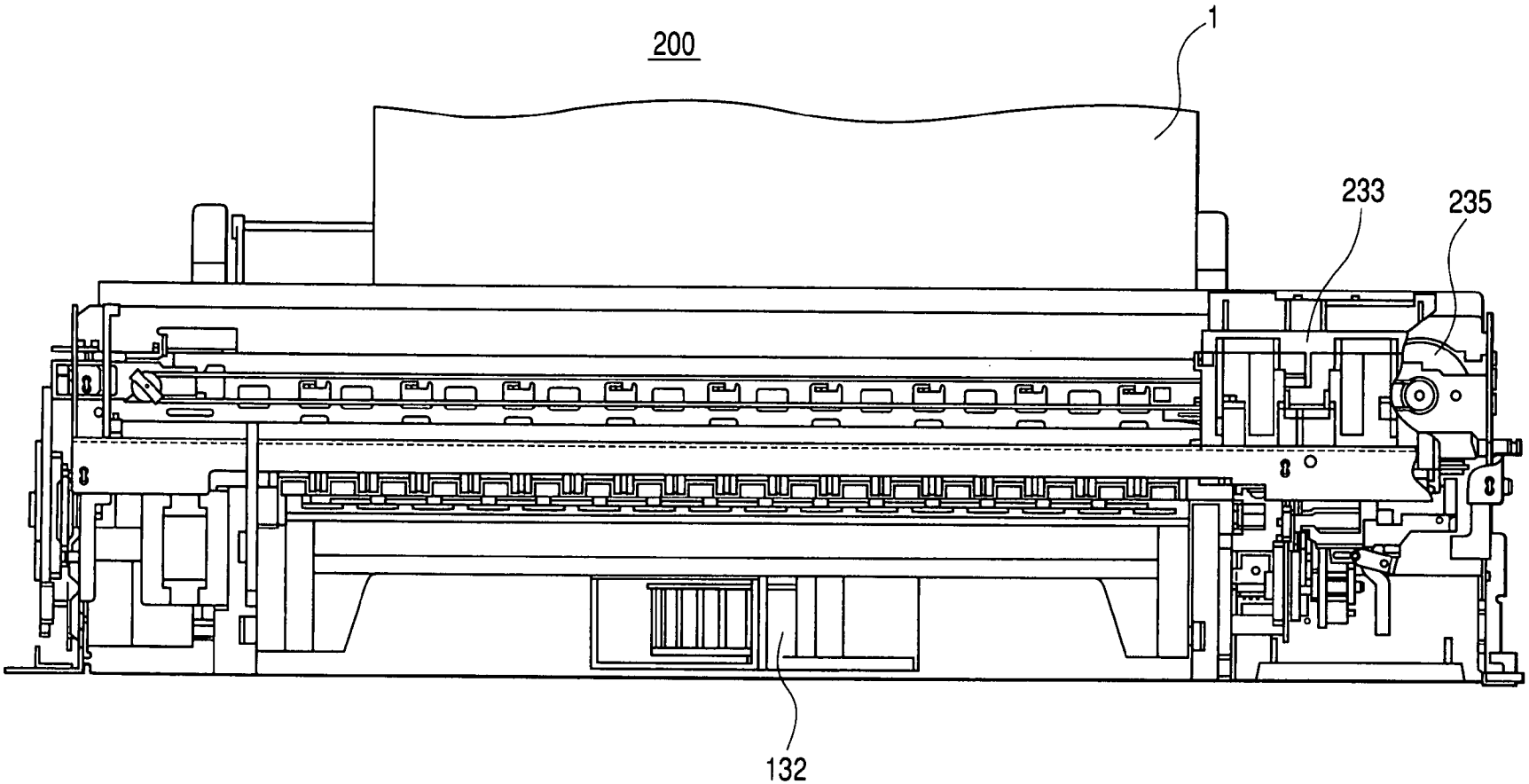
FIG. 7 is a front view showing a main portion of the ink jet printer of FIG. 5.
Figure 8:
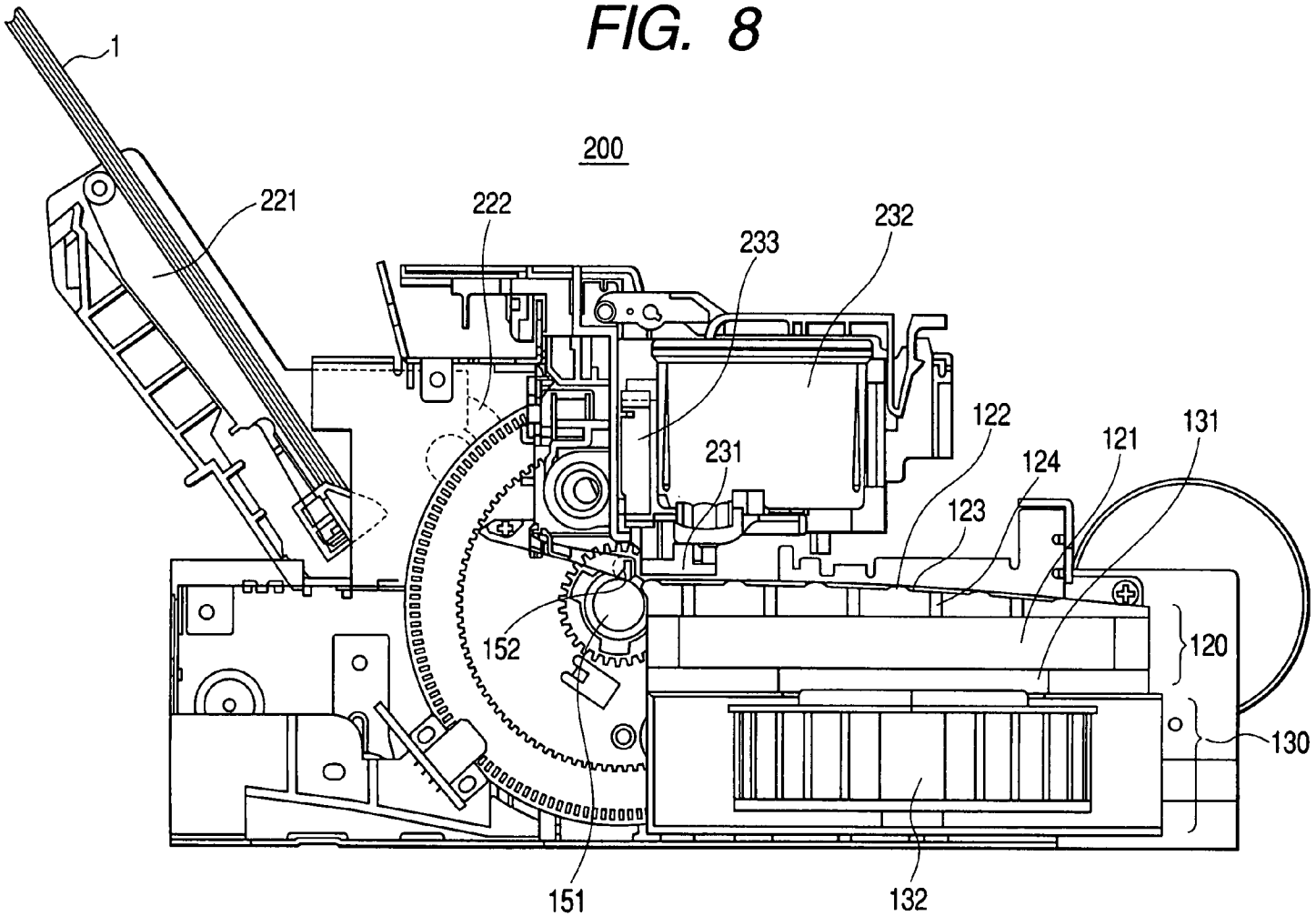
FIG. 8 is a side view showing a main portion of the ink jet printer of FIG. 5.
Figure 9A:
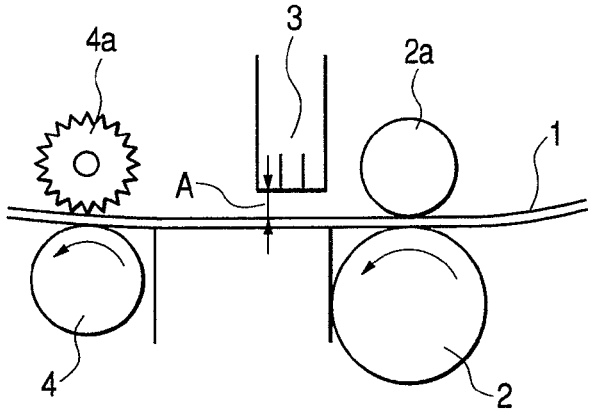
FIG. 9A PRIOR ART
FIGS. 9A to 9C are views showing only main portions of the sheet transportation apparatus in the prior ink jet printer.
Figure 9B:
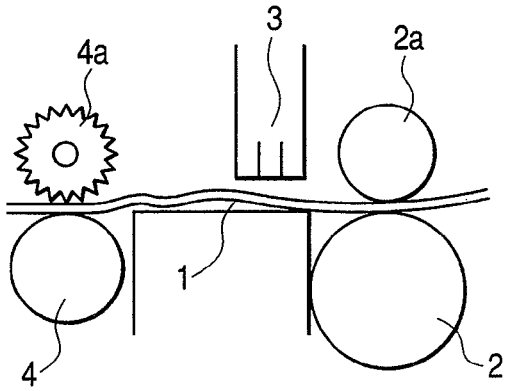
FIG. 9B PRIOR ART
Figure 9C:
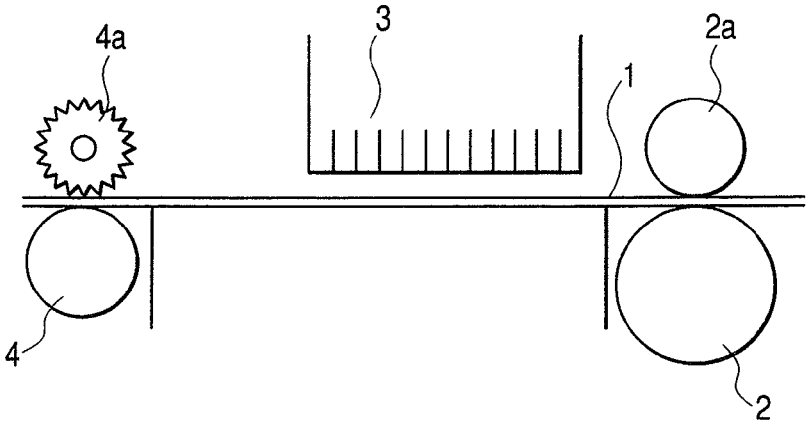
FIG. 9C PRIOR ART

FIG. 5 is a perspective view showing an ink jet printer as a recording apparatus providing the recording medium transportation apparatus of the invention, and FIG. 6 to FIG. 8 are a plan view, a front view, and a side view showing the main portions thereof. The ink jet printer 200 provides an automatic sheet feed (ASF) unit 220 attached obliquely at the rear side upper portion of a printer main body 210, a recording portion 230 built in the printer main body 210, and a recording medium transportation apparatus 100. For the recording medium, various kinds such as exclusive sheet of the ink jet printer 200, normal sheet, OHP film, tracing paper, post card, and so on can be used.

In the embodiment, the ink jet printer 200 provides the recording medium transportation apparatus 160 not needing the discharging roller 153 and the spur roller 154, having the suction unit 110 enabling to move to discharging direction, and having the recording medium transportation surface of positively curved surface shown in FIG. 3. However, the recording medium transportation apparatuses 100 and 170 having the recording medium transportation surface 122 of the reversely curved surface shown in FIG. 1 and the recording medium transportation surface 126 with a step portion 126*c* shown in FIG. 4, further having the discharging roller 153 and the spur roller 154 are applicable similarly.

The ASF unit provides a tray 221 storing the sheets 1, a feed roller 222 drawing out the sheet 1 from the tray 221 and feeding. A recording portion 230 provides a carriage installing a recording head 231 and an ink cartridge, a DC motor 235 moving the carriage 233 along a guide shaft 234 arranged to main scanning direction, and the like. The recording head 231 has a nozzle line consisting of plural nozzles, for example 96 pieces at each color of cyan, magenta, yellow, light cyan, light magenta, light yellow, and black for example.

The ink jet printer 200 having the above construction operates as the following. When recording command to the sheet 1 stored in the tray 221 is inputted by a host computer and the like not shown, the feed roller 222 drives to rotate and feeds the sheet 1 stored in the tray 221 picking up every one sheet. Further, the sheet 1 is transported between the recording head 231 and the suction unit 110 driving to rotate the delivery roller 152 and the like.

On the other hand, the pump 132 drives, and sucking force acts the sucking aperture 124 and the sucking chamber 123 through the connecting aperture 131 and the decompression chamber 121. The sheet 1 is transported at the state sucking to stick to the recording medium transportation surface 125. At the same time, driving the DC motor 235, the carriage 233 is moved along the guide shaft 234 through a timing belt.

At this time, the recording head 231 records by discharging ink discharged on the sheet 1 from the ink cartridge 232 every color corresponding to recording data as small ink drops from whole or one of the plural nozzles. Thus, although cockling possibly generates at the sheet 1 after recording, the sheet 1 is curved in convex shape by being transported along the recording medium transportation surface 125 formed as the positively curved surface, and cockling is drawn so that growth thereof is prevented. Driving to rotate the discharging roller 153 and the like, the sheet having finished recording is discharged outside from the discharging port 201.

As described above, according to the fixed material transportation apparatus and the apparatus fixing liquid of the invention, since the cockling is drawn when the recording medium is transported while curving to transportation direction on the recording medium transportation surface even if cockling extending to transportation direction generates on the recording medium after recording, growth of the cockling can be prevented. Therefore, since gap between the recording medium and the recording head is made the minimum and uniform, and stable carriage is performed, contamination caused by contact of the recording medium and the recording head can be prevented.

What is claimed is:

1. A fixed material transportation apparatus comprising:

a transportation surface on which a fixed material is transported in a transportation direction while being sucked, a pair of delivery rollers located upstream of the transportation surface in the transportation direction, and a pair of discharging rollers located downstream of the transportation surface in the transportation direction, wherein the transportation surface includes:

a first surface including an area where liquid is ejected from a head to the fixed material;

a second surface located downstream of the first surface in the transportation direction; and a step portion through which the first surface is connected to the second surface, wherein the second surface is formed such that the fixed material is transported on the transportation surface at the second surface, wherein the first surface extends to the step portion, wherein, in the transportation direction, a length of the second surface is longer than a length of the first surface, wherein a plurality of sucking holes are formed on the first surface and the second surface, wherein the second surface is disposed between the step portion and the pair of discharging rollers, and wherein the second surface is planar over the entire length thereof in the transportation direction.

2. The fixed material transportation apparatus according to claim 1, wherein the first surface is formed so as to become higher than the second surface.

3. The fixed material transportation apparatus according to claim 1, further comprising:

a decompression chamber connecting to the plurality of sucking holes, and a sucking device sucking air in the decompression chamber, wherein the sucking holes provides a suction unit in which each of sucking holes is provided with a sucking aperture connecting to the decompression chamber and a sucking chamber where an area of sucking surface facing the fixed material is larger than a sectional area of the sucking aperture.

4. A liquid fixing apparatus providing the fixed material transportation apparatus according to claim 1.

* * * * *